United States Patent [19]

Nurimanov et al.

[11] 4,005,643

[45] Feb. 1, 1977

[54] APPARATUS FOR SECURING A BAND ON SHEET BLANKS

[76] Inventors: Myalik Khasyanovich Nurimanov, ulitsa Svobody, 89, korpus 1, kv. 19; Vitaly Afanasievich Kharlamov, Novopeschanaya ulitsa, 13/3, kv. 131; Ivan Ivanovich Zabotin, Sevastopolsky prospekt, 34, kv. 22, all of Moscow, U.S.S.R.

[22] Filed: Mar. 5, 1975

[21] Appl. No.: 555,617

[52] U.S. Cl. ..... 93/1 R; 93/35 PC

[51] Int. Cl.[2] ..... B310 1/00

[58] Field of Search ..... 93/1 R, 35 PC; 156/211, 156/443, 522, 517; 282/11.5 R, 11.5 A

[56] References Cited

UNITED STATES PATENTS

| | | | |
|---|---|---|---|
| 3,470,794 | 10/1969 | Crane, Jr. | 93/35 PC X |
| 3,850,083 | 11/1974 | Falcon | 93/35 PC |

*Primary Examiner*—Leon Gilden

[57] ABSTRACT

An apparatus for securing a band on sheet blanks for the formaton of pockets for collection albums and the like, comprising a framework supporting a system of pairs of vertically arranged driving rollers adapted to advance a blank therebetween, and spring-loaded rods adapted to bend away flaps pre-punched in the blank, arranged parallel to one another in a row to underlie the blank being advanced. The apparatus further comprises guides likewise arranged parallel to one another in a row to overlie the blank being advanced, adapted to introduce bands under the bent-away flaps. Each roller of the first pair is made up of discs mounted in a spaced relationship on an arbor, the rods and guides being positioned within the spaces between these discs.

3 Claims, 4 Drawing Figures

APPARATUS FOR SECURING A BAND ON SHEET BLANKS

The present invention relates to binding equipment, and more particularly, to apparatus for securing a band on sheet blanks for the formation of pockets for collection albums and the like.

There is known an apparatus for forming pockets from a band which is pasted onto an unpunched sheet blank to be subsequently used as a sheet for collection albums. The apparatus includes a frame supporting reels with band and a system of guiding rollers adapted to advance the sheet blank. After the bands have been pasted onto the sheet blank as a plurality of parallel rows, edge trimming of the blank is performed.

The employment of the apparatus for forming pockets on unpunched sheet blanks by pasting a band thereupon has stepped up the productivity of blank making operation, as compared with a manual process; however, the quality of the pockets thus produced has proved to be inadequate.

The bands are apt to unseal themselves from the blank, which prohibits their further use as pockets for holding stamps.

With the bands being pasted onto unpunched sheet blanks, there is a necessity of performing an additional operation, viz. edge finishing of each blank. This necessity involves the use of additional mechanisms, which, in turn, raises the production cost of the finished articles.

There is also known a method of forming pockets from a band on sheet blanks having flaps pre-punched therein, in which method the pockets are formed by the band being introduced manually under the pre-punched flaps bent away from the general plane of the blank.

The last-mentioned operation, although yielding high quality of the pockets formed on the sheet blank, is labor consuming and of low productivity.

Experience shows that during a seven-hour working shift, a worker is capable of manually introducing the bands under approximately six thousand bent flaps.

It is an object of the invention to provide an apparatus enabling mechanization of the operation of introducing a band under pre-punched flaps bent away from the general plane of a sheet blank for collection albums and the like.

Another object of the present invention is to provide an apparatus which will increase the productivity of the above-specified articles.

Still another object of the invention is to provide an apparatus which will make it possible to reduce the cost of manufacture of the product, as compared with that of the same product fabricated manually.

These and other objects are attained in an apparatus for securing a band on sheet blanks for the formation of pockets for collection albums and the like, by introducing the band under flaps pre-punched in the blanks and bent away from their general plane, which apparatus, in accordance with the invention, comprises a frame supporting a system of vertically arranged pairs of driven rollers adapted to advance positively a sheet blank therebetween, each roller of the first pair in the direction of the advance of the blank being constituted by a plurality of discs assembled in a spaced relationship on a common arbor, the apparatus further comprising a plurality of spring-loaded rods adapted to bend the pre-punched flaps away from the plane of the blank, arranged in a parallel row in the spaces between these discs to underlie the blank being advanced, and a plurality of guides for positively fed bands, likewise arranged in a parallel row in the same spaces, to overlie the blank being advanced, each such guide being made as a plate having a V-shape in cross-section, adapted to turn a respective band from a vertical position into a horizontal position, to introduce the band under the flap bent away by a respective rod.

An apparatus having the above-specified arrangement, offers complete mechanization of the operation of introducing a band under the flaps bent away from the plane of the blank.

With the driving rollers being arranged in vertical pairs to advance the blank therebetween the blank is being continuously advanced throughout the operation.

The provision of the spring-loaded rods provides for bending the pre-punched flaps in the blank from the plane thereof during the advance of the blank, while the provision of the V-shaped guides, adapted to turn the bands pre-threaded thereinto from a vertical position into horizontal permits mechanization of the operation of introducing the band under these bent-away flaps.

The arrangement of the rods and guides in full compliance with that of the flaps on the blanks is only possible when each roller of the first pair is in the form of a plurality of spaced discs assembled on a respective arbor.

Thus, the rods and the guides are disposed in the spaces between these discs.

In accordance with another feature of the present invention, the apparatus further comprises a device for separating the blanks, arranged upstream of the last pair of the driving rollers in the direction of the advance of the blank, the device including a stationary knife positioned to underlie the blank being advanced, the stationary knife being secured to the frame of the apparatus, and a movable knife supported by a driven shaft to overlie the blank being advanced.

The last-mentioned device severs the film interconnecting the blanks and thus separates, in a mechanized fashion, each successive outgoing blank wherein the bands have been introduced under the pre-punched flaps from the advancing stream of the blanks interconnected by the bands.

The present invention will be better understood from the following detailed description of an embodiment thereof, with reference to the appended drawings, wherein.

Figure 1:
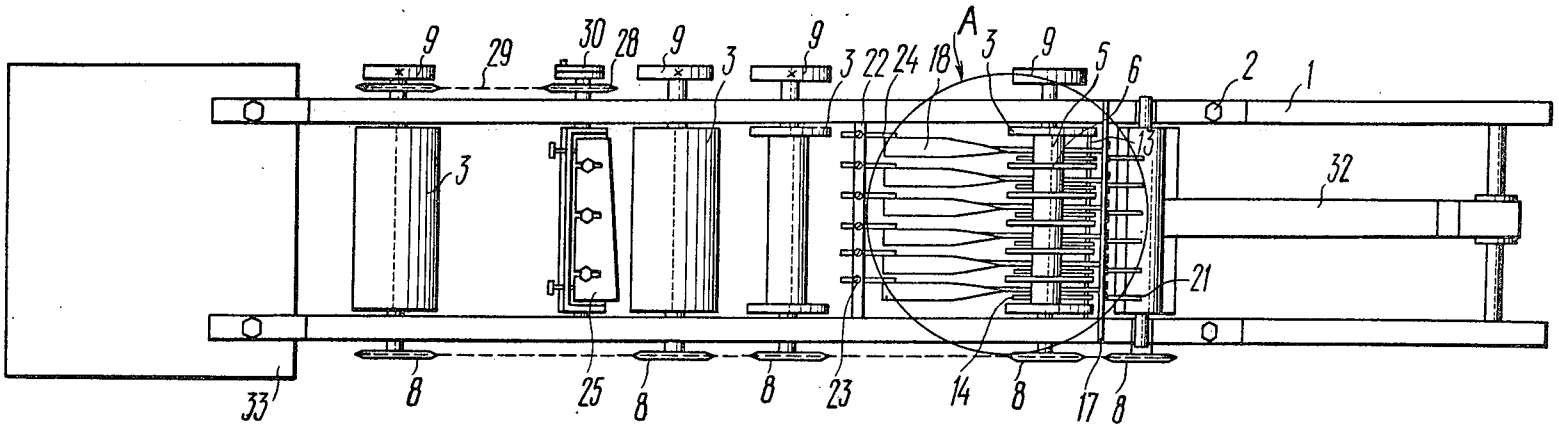
FIG. 1 is a top plan view of an apparatus for forming pockets from a band on sheet blanks for collection albums, in accordance with the invention.
Figure 2:
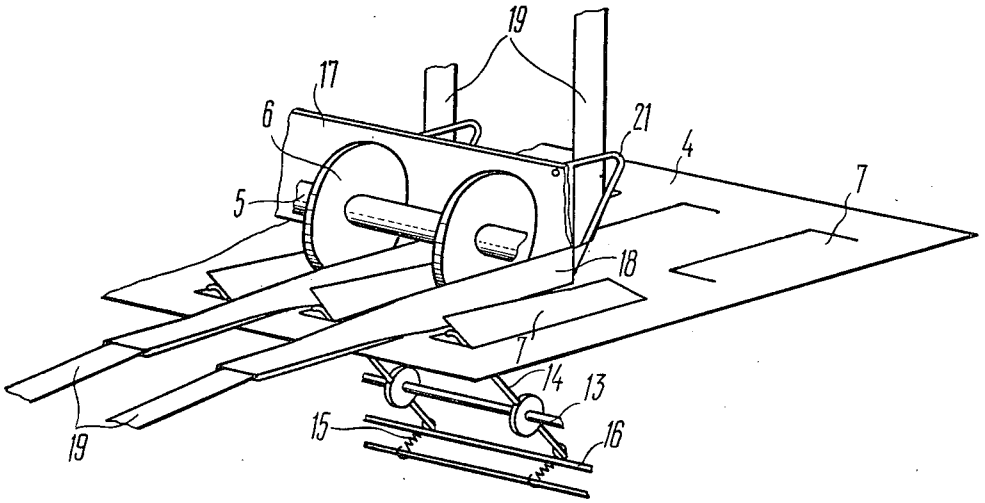
FIG. 2 is an enlarged perspective view, partly broken away, of detail A in FIG. 1.

Referring now in particular to the appended drawings, the apparatus, comprises a frame 1 (FIGS. 1 and 3) made up of a top part and a bottom part bolted together at 2. The frame 1 supports a system of vertical pairs of driving rollers 3 adapted to advance a blank 4 therebetween (FIG. 2). Thus, each pair of the rollers 3 includes a top roller and a bottom roller. Each one of the first pair of the rollers 3 in the direction of the advance of the blank 4 is formed by an arbor 5 supporting a plurality of spaced discs 6. Each disc 6 is positioned to pass between pre-punched flaps 7 in the blank 4, so as not to interfere with bending away of these flaps 7. The rollers of the rest of the vertical pairs 3 may be solid.

One end of the arbor of each roller 3 (FIG. 1) supports a sprocket wheel 8, while the opposite end thereof carries a pinion 9. The rollers 3 are driven in operation by an electric motor 10 (FIG. 3) through a reducer 11 and a driving chain 12, the rollers being thus drivingly interconnected by means of their sprocket wheels 8 and pinions 9.

Positioned upstream of the first pair of the rollers 3 in the direction of the advance of the blank 4 is a spindle 13 mounted on the frame 1 and supporting thereon a row of parallel rods 14 for bending away the flaps 7 pre-punched in the blanks 4, the rods being pivotable through a limited angle relative to the frame 1. The rods 14 are positioned to underlie the blank 4 being advanced and are each associated with an extension spring 15 and an abutment 16, to allow the free end of each rod 14 to slightly project above the level of the blank 4 being advanced.

Each rod 14 is positioned within a respective space between the discs 6, to engage a respective flap 7 passing thereabove.

Figure 4:
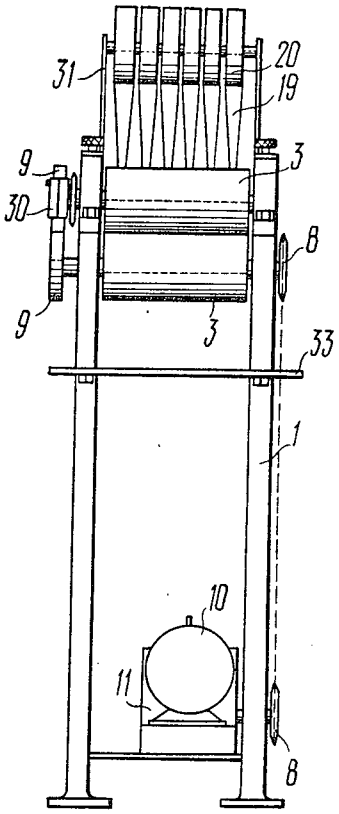
FIG. 4 is a side elevation view of the apparatus.
Figure 3:
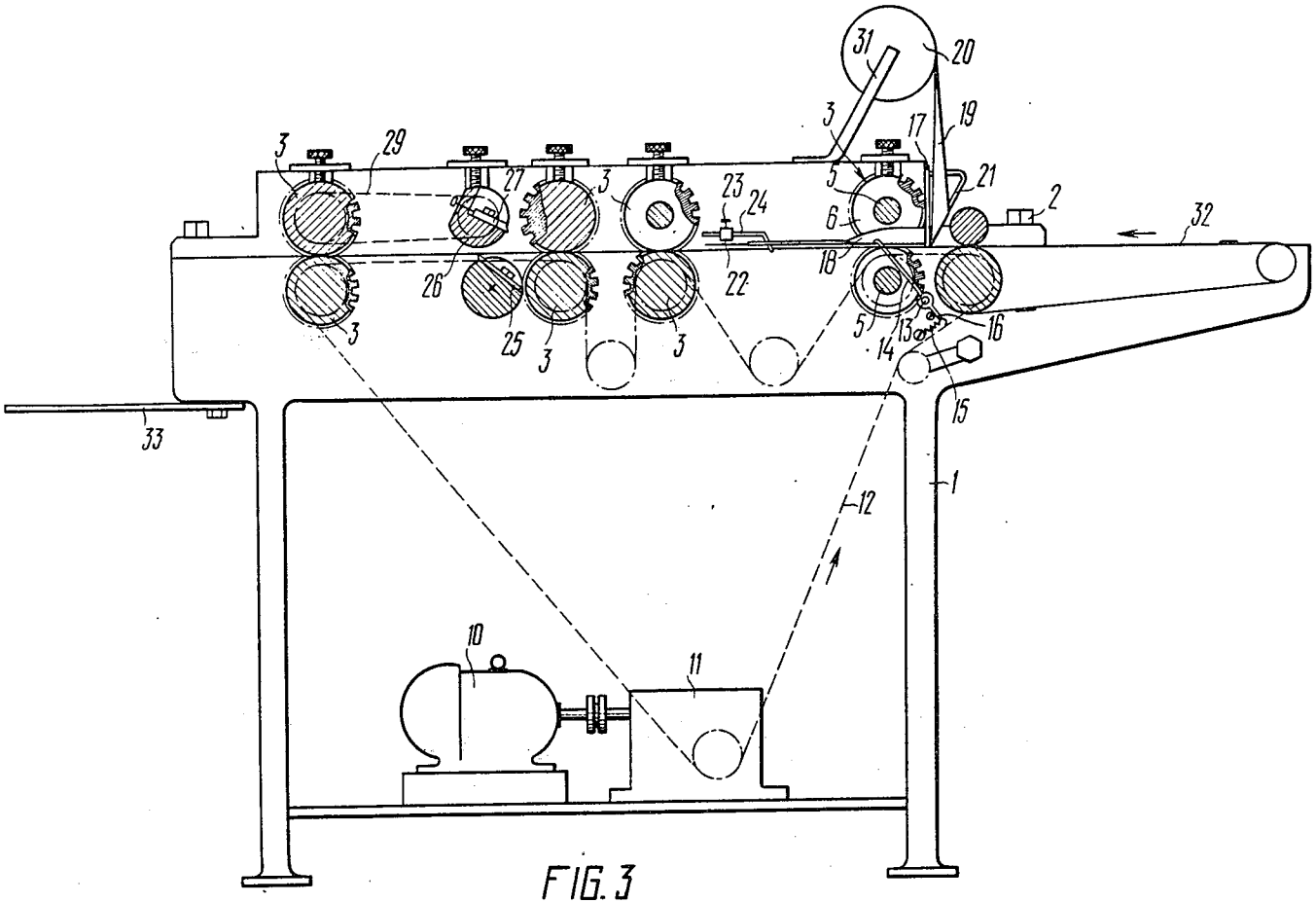
FIG. 3 is a partly sectional front elevation view of the apparatus.

The apparatus further comprises a plate 17 mounted on the frame 1 upstream of the same first pair of the driving rollers 3, the plate 17 supporting a row of parallel guides 18 positioned within the same respective spaces between the guides 6 to overlie the blank 4 being advanced, the discs 18 being adapted for cooperation with respective bands 19 positively unwound from supply reels 20 (FIGS. 3 and 4). Each guide 18 is in the form of a plate, twisted from a vertical position into a horizontal position, to introduce the band under the flap 7 bent away from the general plane of the blank 4 by the respective rod 14.

Each band 19 is associated with a bracket 21 on the plate 17, to guide the band, as the latter is being inserted into a respective guide 18.

To independently adjust the position of each guide 18, the apparatus includes a strip 22 mounted on the frame 1 and supporting thereon a plurality of movable stops 24 secured in an adjusted position with screws 23.

In accordance with one feature of the present invention, the apparatus further comprises a device for separating the blanks by severing the bands 19, the device being arranged upstream of the last pair of the rollers 3 in the direction of the advance of the blanks 4 and including a stationary knife 25 mounted on the frame 1 to underlie the blanks 4 being advanced and a driven shaft 26 having mounted thereon a movable knife 26 overlying the blanks 4 being advanced.

The shaft 26 rotatably supports a sprocket wheel 28.

The shaft 26 with the movable knife 27 is rotated by a driving chain 29 receiving its motion from the last pair of the rollers 3 in the direction of the advance of the blanks 4.

To sever the bands 19, the knife 27 has to rotate but through a single revolution. This is provided for by the shaft 26 supporting thereon a single-revolution clutch 30 (FIG. 1) effecting driving engagement of the shaft 26 and the sprocket wheel 28 for one full revolution of the knife 27. The knife 27 is thus actuated when the clutch 30 receives an engagement signal from an electric pick-up (not shown) spaced from the knives 26 and 27 in the direction of the advance of the blanks 4 by a distance which is a multiple of the respective dimension of the blank 4. Upon receiving this signal, the clutch 30 is engaged in any suitable known manner and drivingly connects the shaft 26 of the movable knife 27 to the sprocket wheel 26, whereby the knife is rotated through one full revolution and cooperates with the stationary knife 25, to sever the bands 19 and thus to separate each successive exiting blank 4 from the advancing stream of the blanks 4 interconnected by the bands 19.

The herein disclosed apparatus operates as follows. The reels 20 (FIG. 3) of bands 19 are mounted in a reel holder 31 supported by the frame 1. Each band 19 is a strip of either Lavsan or polypropylene film 20 to 30 mμ thick, the width of this strip being 3 to 4 mm greater than the respective dimension of the flap 7 prepunched in the blanks 4 which are to be further assembled into collection albums and the like.

The number of the reels 20 of the bands 19 corresponds to that of the guides 18, which, in turn, corresponds to the quantity of the rows of the flaps 7 in the blanks 4.

Each band 19 is pre-introduced into the respective V-shaped guide 18, for the free end of this band 19 to project from the guide 18 by 5 to 8 mm.

This done, the electric motor 10 is energized, to transmit rotation through the reducer 11 and the driving chain 12 to the sprockets 8 which thus effect rotation of the bottom ones of the rollers 3, the latter transmitting rotation to the top ones of the rollers 3 through respective pinions 9.

Then the blanks 4 with the flaps 7 pre-punched therein are fed one by one with a 1 to 2 cm spacing onto a feed-in conveyor 32 which delivers them toward the first pair of the rollers 3 of the apparatus, the discs 6 of this first pair of the rollers 3 engaging the successive blanks and advancing them positively toward the successive pair of the rollers 3. While advancing the blanks 4, the discs 6 of the first pair of the rollers 3 roll over the spaces between the flaps 7 pre-punched in the blanks 4.

As the blank 4 passes above the spring-loaded rods 14, the solid areas of the blank 4 depress the respective ends of the rods 14 against the action of the springs 15 to a level below that of the blank 4. However, when a flap 7 passes above the rod 14, the latter is urged by the respective spring 15 into its operating position whereat the end of the rod 14 projects slightly above the level of the blank, bending this flap 7 away from the plane of the blank 4 and thus forming a slit under this bent flap 7. The respective V-shaped guide 18 with the band 19 enters this slit formed between the bent-away flap 7 and the blank 4. Upon the blank 4 having been advanced by a distance sufficient for the flap 7 to clear the respective rod 14, the solid area of the blank 4 again depresses the end of the rod 14 to a level below that of the advancing blank 4, while the flap 7 resumes its initial position, closing the slit and clamping the band 19 thereunder.

Consequently, the band 19 clamped by the successive flaps 7 of the blank 4 advances jointly with the latter, unwinding from the respective reel 20. As the blank 4 is advanced further the band 19 is introduced by the guide 18 under each successive flap 7 prepunched in the blank 4.

The blank 4 with the bands 19 introduced under the flaps 14 is advanced by the successive pairs of the rollers 3 toward the blank-separating device.

The advancing successive blanks are interconnected by the bands 19 introduced thereinto, the bands being severed in the spaces between the blanks 4 by this device.

An electric pick-up (not shown) arranged in the path of the advancing blanks 4 and spaced from the severing device by a distance which is a multiple to the respective dimension of the blank 4 produces each time it enters the space between the successive blanks 4, a control signal and sends it to the clutch 30 which, in response to this signal, establishes a driving connection between the shaft 26 of the movable knife 27 and the sprocket 28, whereby the knife 27 is rotated through one full revolution. During this revolution, the movable knife 27 cooperates with the stationary knife 25, whereby the bands 19 are severed, and the leading blank 4 is separated.

The separated blank 4 is advanced by the last pair of the driving rollers 3 onto a delivery table 33.

The apparatus of the herein disclosed kind has been found capable of introducing the bands under 100,000 flaps in 7 working hours.

What is claimed is:

1. An apparatus for securing a band on sheet blanks for the formation of pockets for collection albums and the like, comprising: a framework; a system of vertically arranged pairs of driving rollers supported by said framework for positively advancing a succession of blanks therebetween; means for rotating said rollers; each of the first of said pairs of said rollers, in the direction of the advance of the blanks, being constituted as an arbor with a plurality of discs mounted on said arbor in spaced relationship; a plurality of spring-loaded rods supported adjacent the path of the blanks to bend away pre-punched flaps formed in said blanks, said rods being arranged parallel to one another in a row within respective spaces between said discs and under the advancing blanks; a plurality of guides for positive feed of respective bands, said guides being arranged parallel to one another in a row within said respective spaces between said discs above the advancing blanks, each said guide being in the form of a twisted plate having a vertical inlet portion and a horizontal outlet portion to turn a respective band from a vertical position into a horizontal position, said horizontal portion being positioned to introduce said band under the flap bent away by the respective one of said rods.

2. Apparatus as claimed in claim 1 further comprising cutting means arranged upstream of the last one of said pairs of said rollers in the direction of advance of said blanks, said cutting means being constructed to separate the band between successive ones of said blanks being advanced and including a stationary knife supported by said framework to underlie the advancing blanks, a movable knife, and a power-driven shaft supporting said movable knife above said stationary knife, to overlie the advancing blanks.

3. Apparatus as claimed in claim 1 wherein said rods are pivotably supported beneath the advancing blanks, said apparatus further comprising spring means acting on said rods to bias the same upwardly against the bottoms of the advancing blanks.

* * * * *